US007461465B2

(12) United States Patent
Lee-Smith

(10) Patent No.: US 7,461,465 B2
(45) Date of Patent: Dec. 9, 2008

(54) PRESSURE CONTROL IN CENTRIFUGAL EVAPORATORS

(75) Inventor: Roger Lee-Smith, Hadleigh (GB)

(73) Assignee: Genevac Ltd., Ipswich, Suffolk (GB)

( * ) Notice: Subject to any disclaimer, the term of this patent is extended or adjusted under 35 U.S.C. 154(b) by 376 days.

(21) Appl. No.: 10/526,976

(22) PCT Filed: Oct. 29, 2003

(86) PCT No.: PCT/GB03/04681

§ 371 (c)(1),
(2), (4) Date: Aug. 22, 2005

(87) PCT Pub. No.: WO2004/040214

PCT Pub. Date: May 13, 2004

(65) Prior Publication Data

US 2006/0101664 A1 May 18, 2006

(30) Foreign Application Priority Data

Oct. 31, 2002 (GB) ..... 0225329.2

(51) Int. Cl.
*F26B 5/04* (2006.01)
*F26B 13/30* (2006.01)

(52) U.S. Cl. ..... 34/403; 34/92

(58) Field of Classification Search ..... 34/92, 34/403, 406, 58, 312
See application file for complete search history.

(56) References Cited

U.S. PATENT DOCUMENTS 5,137,604 A * 8/1992 Meeks et al. ..... 202/205
5,263,268 A * 11/1993 Meeks et al. ..... 34/92

* cited by examiner

*Primary Examiner*—Jiping Lu
(74) *Attorney, Agent, or Firm*—Barnes & Thornburg LLP

(57) ABSTRACT

A method of controlling the pressure within a chamber (12) of a drying apparatus (10) from which air and vapour is removed by a pump (30), which is operated continuously during the drying process. If both of a vent valve (18) and a pressure control valve (32) is opened, air at atmospheric pressure is drawn by the pump (30) directly from the pressure control valve (32), and via the chamber (12) and a non-return valve (26) from the vent valve (18). When the pressure in the chamber (12) is to be reduced both vent and pressure control valves (18, 32) are closed to allow the pump (30) to remove air, gas and vapor from the chamber (12) via the non-return valve (26). After a required chamber pressure has been reached, the pressure control valve (32) is opened while the vent valve (18) remains closed.

8 Claims, 1 Drawing Sheet

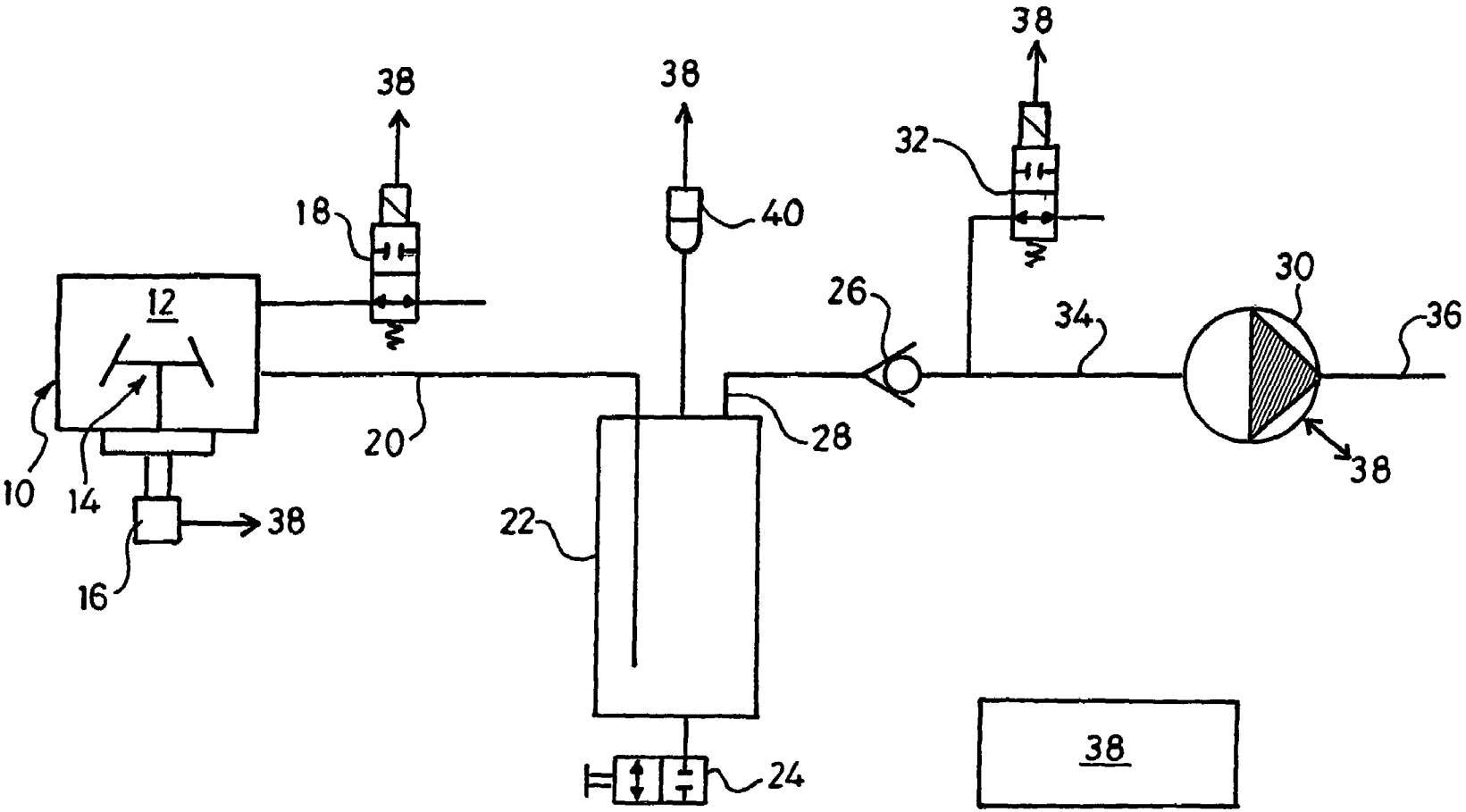
36
38
30
38
34
38
32
26
28
40
38
24
22
38
20
18
38
12
14
16
10

PRESSURE CONTROL IN CENTRIFUGAL EVAPORATORS

FIELD OF INVENTION

This invention concerns drying apparatus, especially centrifugal evaporators and in particular the control of pressure within the drying chamber of such apparatus.

BACKGROUND

Control of pressure in drying apparatus such as centrifugal evaporators is important for 3 reasons:

(i) To allow controlled reduction of the chamber pressure in order to prevent bumping (ii) To limit the ultimate chamber pressure so as to prevent solvent from freezing during evaporation. This is particularly important when evaporating water. Evaporation from the solid phase (sublimation) is much slower than evaporation from the liquid phase.

(iii) To limit the ultimate chamber pressure in order to maximize solvent recovery. This is particularly important with volatile solvents, typically those that would boil at −30° C. or below at the ultimate pressure achieved in the chamber.

There are two methods in common use for controlling pressure:

In a first method which has been used, possibly for 20 years or more to control pressure in Freeze Dryers, an adjustable bleed valve is connected to the drying chamber, and in use a controlled amount of nitrogen or air is steadily bled into the chamber while continuously vacuum pumping the chamber. This method allows objectives (ii) and (iii) to be achieved but objective (i) proved very difficult to achieve when the object is to secure an increasing vacuum ramp. Proportional control of the bleed valve over a large dynamic range would be required to achieve all three requirements listed above.

A second method is described in U.S. Pat. No. 5,137,604. Here the pump is isolated from the chamber in response to a signal proportional to the pressure within the drying chamber. This method works well with pumps that: a) do not suffer from condensation of vapors internally (e.g. scroll pumps, vane pumps with gas ballasting), b) would shed oil if operated open to atmosphere for extended periods (vane pumps). This method has some disadvantages: the isolation valve must be solvent resistant and as such is a relatively expensive component because the bore must be large. When used to control the pressure with pumps that suffer from performance loss when solvents condense internally it is found that performance decreases significantly over the duration of an evaporation run. Pump performance is only recovered when a significant flow rate of gas is once again established through the pump, to force out the condensed solvent. Multi-head diaphragm pumps, which are commonly used for evaporation equipment are affected badly by solvents condensing internally. An additional problem which has been found due to liquid solvent entrapment within the pump, is premature degradation of the pump components especially elastomeric seals within the pump.

Apparatus for solvent removal will be referred to as drying apparatus. Drying apparatus can include centrifugal evaporators, freeze driers, and rotary evaporators in which a film of solvent is maintained over the inside surface of a flask by rotating it in a warm fluid.

OBJECT

Objects of the invention are to provide an improved method and apparatus for removing a solvent from a mixture in a closed chamber so as to leave a dry residue, to enable the pressure within the chamber to be precisely controlled.

SUMMARY OF THE INVENTION

According to one aspect of the present invention there is provided a method of controlling the pressure within a chamber of a drying apparatus from which air and vapor is removed by a pump which is operated continuously during the drying process, wherein both of a vent valve and a pressure control valve are opened so that air at atmospheric pressure is drawn by the pump directly from the pressure control valve, and via the chamber and a non-return valve from the vent valve and when the pressure in the chamber is to be reduced both vent and pressure control valves are closed to allow the pump to remove air, gas and vapor from the chamber via the non-return valve, and the dropping chamber pressure is monitored by a pressure transducer and after a required chamber pressure has been reached, the pressure control valve is opened while the vent valve remains closed, whereby a high rate of airflow is maintained through the pump to clear the interior of the pump of any residual solvent.

The chamber pressure will remain substantially constant until the control valve is once again closed (or partially closed).

The invention therefore removes solvent condensation within the pump which can otherwise remain inside the pump when the pump is isolated from the chamber.

The invention also lies in a method of operating a vacuum drying chamber such that with the vent valve closed and the pressure control valve open, air at atmospheric pressure enters through the pressure control valve and the non-return valve sees atmospheric pressure on the pump side and a "lower" at least partial vacuum pressure in the chamber on the other side. The differential pressure keeps the non-return valve closed, thereby sealing the chamber from atmosphere. However the open pressure control valve provides a ready supply of air at atmospheric pressure to the pump inlet which thus maintains a high flow rate therethrough, so as to clear any solvent from the interior of the pump.

Clearing solvent from the internal surfaces of the pump ensures that the pump will continue to operate at peak performance and extends the life of the pump in service by eliminating solvent attack.

According to another aspect of the present invention there is provided drying apparatus which includes a drying chamber, control means for controlling the pressure within the chamber, a pump adapted to remove air gas and vapor from the chamber and which is operated continuously during the drying process, a vent valve which when open admits air to the chamber, a pressure control valve which when open admits air directly to the pump inlet, a non-return valve between the chamber and the pump inlet, and control means adapted to close both vent and pressure control valves when the pressure in the chamber is to be reduced by the removal of air, gas and vapor from the chamber by the pump through the non-return valve, the control means being adapted to at least partly open the pressure control valve while keeping the vent valve closed when a given partial vacuum pressure is achieved in the chamber, whereby a high rate of air flow is maintained through the pump to clear the interior of the pump of solvent, while the chamber pressure remains substantially constant.

If the control valve is closed once again, air, gas and vapor will once again drawn from the chamber by the operation of the pump to further reduce the pressure in the chamber, and to this end a new lower vacuum pressure must be identified before the control valve is closed.

The apparatus preferably further comprises a pressure transducer means adapted to monitor the chamber pressure and to provide a signal to the control means.

In one arrangement the transducer signal is proportional to the chamber pressure and the control means compares the chamber pressure signal value with a programmed pressure value corresponding to the given chamber pressure to generate a signal to open the control valve when the given pressure is reached.

In another arrangement the transducer means includes programmable means by which a given pressure can be entered and the transducer delivers a signal to the control means when the given pressure is detected in the chamber, to open the control valve.

The pressure control and vent valves can be low cost valves, as they are not subjected to solvent vapor, only air.

The non-return valve may be a flap valve.

The non-return valve does not have to provide a 100% seal, as it is only required to close when the system is maintaining the chamber pressure. If some leakage occurs during this process, the pressure in the chamber will begin to rise and by sensing this and closing (or partially closing) the pressure control valve, the pump is re-connected to the chamber sooner than would have otherwise been the case, to draw air, gas and vapor from the chamber and thereby regain the required lower pressure, whereupon the pressure control valve is once again opened up and the non-return valve again operates to close off the chamber.

Where the non-return valve is a flap valve it can be manufactured in the same way as non-return valves which are used internally within many diaphragm pumps. These valves are low cost but nevertheless solvent resistant, and are "passive" valves in that they close in response to a differential pressure in one direction.

The benefits provided by the invention are:

(a) Pump performance is no longer degraded due to condensation within the pump.

(b) Premature failure of the pump due to internal chemical attack from condensed solvents within the pump is largely eliminated.

(c) The cost of a pressure control system is reduced since it is no longer necessary to use chemically resistant solenoid valves.

The invention will now be described by way of example with reference to the accompanying drawing.

The drawing illustrates a centrifugal evaporator 10 having a sealable chamber 12 containing a sample holding rotor 14 driven by a motor 16. A normally open solenoid operated vent valve 18 controls the admission of air to the chamber.

A pipeline 20 allows air, gas and vapors to be drawn out of the chamber 12 via a condenser 22 having a drain valve 24 and thereafter via a non-return valve 26 provided in accordance with the invention between the trap outlet 28 and a vacuum pump 30. The condenser may be chilled to more effectively condense the mixture leaving the chamber 12.

A second normally open solenoid operated valve 32 allows air at atmospheric pressure to enter the line 34 downstream of the valve 26 in accordance with the invention, to allow air at atmospheric pressure to be available to the inlet to the pump 30 along line 34.

The outlet of pump 30 communicates with atmosphere at 36 possibly via a filter or gas collecting vessel (not shown) if it is not appropriate to allow any of the air/gas from the chamber 12 to exit directly to atmosphere.

A programmable control system 38 supplies control signals to the solenoid operated valves 18, 32, and operating current to the motor 16 and to a motor (not shown) of pump 30. A pressure sensor 40 monitors the chamber pressure by a connection to the condenser 22 and supplies a pressure-indicating signal to 38.

The control system is preferably computer controlled and has appropriate interface boards for converting digital signals from the computer to analogue signals or operating currents as appropriate, and for converting the typically analogue signal from the transducer 40 to a digital signal for use by the computer.

The invention claimed is:

1. A method of operating a vacuum drying chamber having a vent valve, a non-return valve leading to a vacuum pump and a pressure control valve which communicates with the inlet to the pump, comprising the steps of:

(a) closing the vent valve;

(b) opening the pressure control valve, thereby allowing air at atmospheric pressure to enter through the pressure control valve and subjecting the non-return valve to atmospheric pressure on the pump side; and (c) subjecting the non-return valve to a lower at least partial vacuum pressure in the chamber on the other side, such that the differential pressure keeps the non-return valve closed, thereby sealing the chamber from atmosphere while the open pressure control valve provides a ready supply of air at atmospheric pressure to the pump inlet which thus maintains a high flow rate therethrough, thereby to clear any solvent from the interior of the pump.

2. A method as claimed in claim 1 including the step of varying the chamber pressure by adjusting the amount by which the pressure control valve is opened.

3. A method of controlling the pressure within a chamber of a drying apparatus from which air and vapour is removed by a pump which is operated continuously during the drying process, wherein the chamber has a vent valve and a non-return valve is provided between it and the pump, and the pump has a pressure control value which communicates with an inlet thereof, comprising the steps of:

(a) opening both the vent valve and the pressure control valve so that air at atmospheric pressure is drawn by the pump directly from the pressure control valve, and via the chamber and the non-return valve from the vent valve;

(b) closing both vent and pressure control valves when the pressure in the chamber is to be reduced to allow the pump to remove air, gas and vapour from the chamber via the non-return valve;

(c) monitoring the dropping chamber pressure by a pressure transducer; and (d) opening the pressure control valve after a required chamber pressure has been reached while the vent valve remains closed, whereby a high rate of airflow is maintained through the pump to clear the interior of the pump of any residual solvent.

4. Vacuum drying apparatus comprising a drying chamber, control means for controlling the pressure within the chamber, a pump arranged to remove air, gas and vapour from the chamber, a vent valve which when open admits air to the chamber from outside the apparatus, a pressure control valve which when open admits air directly to the pump inlet from outside the apparatus, and a non-return valve between the chamber and the pump inlet, wherein the control means is arranged to close both vent and pressure control valves when the pressure in the chamber is to be reduced by the removal of air, gas and vapour from the chamber by the pump through the non-return valve, and to at least partly open the pressure control valve while keeping the vent valve closed when a given partial vacuum pressure is achieved in the chamber, whereby a high rate of air flow from the pressure control valve is maintainable the pump by continuous operation thereof during the drying process to clear the interior of the pump of solvent, while the chamber pressure remains substantially constant.

5. Apparatus as claimed in claim 4 further comprising a pressure transducer means adapted to monitor the chamber pressure and to provide a signal to the control means.

6. Apparatus as claimed in claim 5 wherein the transducer signal is proportional to the chamber pressure and the control means compares the chamber pressure signal value with a programmed pressure value corresponding to the given chamber pressure to generate a signal to open the pressure control valve when the given pressure is reached.

7. Apparatus as claimed in claim 5 wherein the transducer means includes input means by which a given pressure can be entered and the transducer means delivers a signal to the control means when the given pressure is detected in the chamber, to open the pressure control valve.

8. Apparatus as claimed in claim 4 wherein the non-return valve is a flap valve.

* * * * *